US005911805A

United States Patent [19]

Sterr et al.

[11] Patent Number: 5,911,805

[45] Date of Patent: Jun. 15, 1999

[54] SPECIALTY DIE CUT CONFETTI AND A METHOD OF MANUFACTURE

[76] Inventors: Ardina K. Sterr; S. Clark Bason, both of 6842 Hayvenhurst Ave., Van Nuys, Calif. 91406

[21] Appl. No.: 09/021,064

[22] Filed: Feb. 9, 1998

Related U.S. Application Data

[63] Continuation-in-part of application No. 08/658,834, May 31, 1996, Pat. No. 5,797,304.

[51] Int. Cl.[6] ..... B26D 7/06

[52] U.S. Cl. ..... 83/27; 83/55

[58] Field of Search ..... 83/27, 55, 84, 83/86, 471.2, 481, 552; 446/475, 491; 30/278, 279.2, 314, 315, 358, 364

[56] References Cited

U.S. PATENT DOCUMENTS

| | | |
|---|---|---|
| D. 385,824 | 11/1997 | Sterr et al. . |
| 825,843 | 7/1906 | Kliemandt . |
| 1,084,636 | 1/1914 | Hunerkopf . |
| 1,090,778 | 3/1914 | Clark . |
| 1,122,421 | 12/1914 | Redington et al. . |
| 1,491,809 | 4/1924 | Macchia . |
| 1,663,679 | 3/1928 | Carpenter . |
| 3,398,614 | 8/1968 | Cleary . |
| 3,616,720 | 11/1971 | Larson . |
| 3,677,117 | 7/1972 | Cutter . |
| 3,826,170 | 7/1974 | Jones et al. . |
| 4,043,234 | 8/1977 | Godin et al. . |
| 4,210,041 | 7/1980 | Mitman et al. . |
| 4,613,321 | 9/1986 | Kesten et al. . |
| 4,798,116 | 1/1989 | Silver et al. . |
| 4,932,915 | 6/1990 | Boris et al. . |
| 5,199,745 | 4/1993 | Balsamo . |
| 5,295,633 | 3/1994 | Kimbro et al. . |
| 5,352,148 | 10/1994 | Watkins . |
| 5,354,227 | 10/1994 | Watkins . |
| 5,388,490 | 2/1995 | Buck . |
| 5,403,225 | 4/1995 | Watkins . |
| 5,419,731 | 5/1995 | Watkins . |
| 5,487,706 | 1/1996 | Wiik . |
| 5,495,671 | 3/1996 | Shun-Yi . |
| 5,507,680 | 4/1996 | Watkins . |
| 5,620,354 | 4/1997 | Watkins . |
| 5,643,042 | 7/1997 | Watkins . |

FOREIGN PATENT DOCUMENTS

| | | |
|---|---|---|
| 341784 | 1/1931 | United Kingdom . |

*Primary Examiner*—M. Rachuba
*Attorney, Agent, or Firm*—Lyon & Lyon LLP

[57] ABSTRACT

A novel design and method of manufacturing confetti uses an interior cutout type die-cutting process. The resulting die cut confetti has unique and unusual aerodynamic features creating visually pleasing flight patterns.

The predominant descent pattern of this new confetti is a hover action. The confetti rocks slightly back and forth during its descent but primarily remains parallel to the ground.

11 Claims, 9 Drawing Sheets

SPECIALTY DIE CUT CONFETTI AND A METHOD OF MANUFACTURE

CROSS-REFERENCE TO RELATED APPLICATIONS

This application is a continuation-in-part of U.S. application Ser. No. 08/658,834, filed May 31, 1996, now U.S. Pat. No. 5,797,304, which claims the benefit of U.S. application Ser. No. 08/639,249, filed Apr. 23, 1996, now abandoned; U.S. application Ser. No. 29/053,517, filed Apr. 23, 1996, now U.S. Pat. No. Des. 397,640; U.S. application Ser. No. 29/053,622, filed Apr. 23, 1996, now Pat. No. Des. 395,617; and U.S. application Ser. No. 29/053,516, filed Apr. 23, 1996, U.S. Pat. No. Des. 385,824.

BACKGROUND OF THE INVENTION

The invention relates to specialty confetti and a unique characteristic achieved through a specific method for its manufacture.

Confetti has often been created from scrap paper such as small round circles from the manufacture of spiral or three-hole punch notebooks or other waste material. Confetti has also been made quickly in large quantities by a traditional method of cutting several sheets of tissue paper with a straight edge paper cutter.

The disadvantages of traditional confetti methods of manufacture are numerous. First, the use of paper scraps such as circles or irregular shapes is limited in design and ease of manufacture. As scraps are not intended to be confetti, they are typically either a standard geometric shape (circle, square, rectangle, triangle) or a completely irregular unidentifiable shape. Further, as scraps are not the intended product, the confetti must be collected from the waste of the manufacture of other goods and packaged as waste or a byproduct. Such a method of manufacture is time consuming and inefficient for rapid mass production of a specific design of confetti.

Confetti manufactured by the use of a straight edge paper cutter limits the shape of the various possible confetti designs to geometric shapes composed of straight lines such as triangles, rectangles, squares and other tetragonal shapes.

As disclosed in pending U.S. U.S. Pat. No. Application No. 08/658,834, which is hereby incorporated by reference as if fully set forth herein, the die-cut confetti disclosed therein focuses on shapes or designs that can be identified by the perimeter edge of the cut-out, such as hearts, bells, stars and circles. These differently shaped confetti display some unusual aerodynamic features and pleasing flight patterns that are not observed with standard confetti.

SUMMARY OF THE INVENTION

The present invention is directed to a novel design and method of manufacturing confetti by the use of an interior cutout type die-cutting process. The present invention includes a unique die cut confetti that has unusual aerodynamic features that create visually pleasing flight patterns that have not been previously observed with confetti.

The relatively new die cutting process is modified to create the present invention. A die-cutting element is added to create an interior cut-out type confetti. The result is a somewhat doughnut-like effect, leaving an exterior perimeter ring which is the specialty confetti. This new method of confetti manufacture allows the production of two types of confetti, simultaneously. For example, in the doughnut example, a stack of ring confetti and a stack of circular confetti is manufactured simultaneously. The potential shapes for the interior cut-out type confetti is not limited to circles, but can be used with any die cut confetti such as bells, stems, doves, hearts, leaves, etc., as disclosed in U.S. patent application Ser. No. 08/658,834.

The interior cutout type confetti possesses dramatically different and unique descent or flight patterns. The confetti has a hover-like quality as it slowly drifts through the air toward the ground. The individual confetti pieces rock slightly back and forth but primarily remain in a plane parallel to the ground during their descent. The cutout in the doughnut confetti permits air to flow through the confetti's hollow center, while the air pressure on the confetti itself creates a hover action. This hover-like effect is not observed in other types of confetti and creates a unique visually pleasing effect.

DETAILED DESCRIPTION OF THE DRAWINGS

Figure 1:
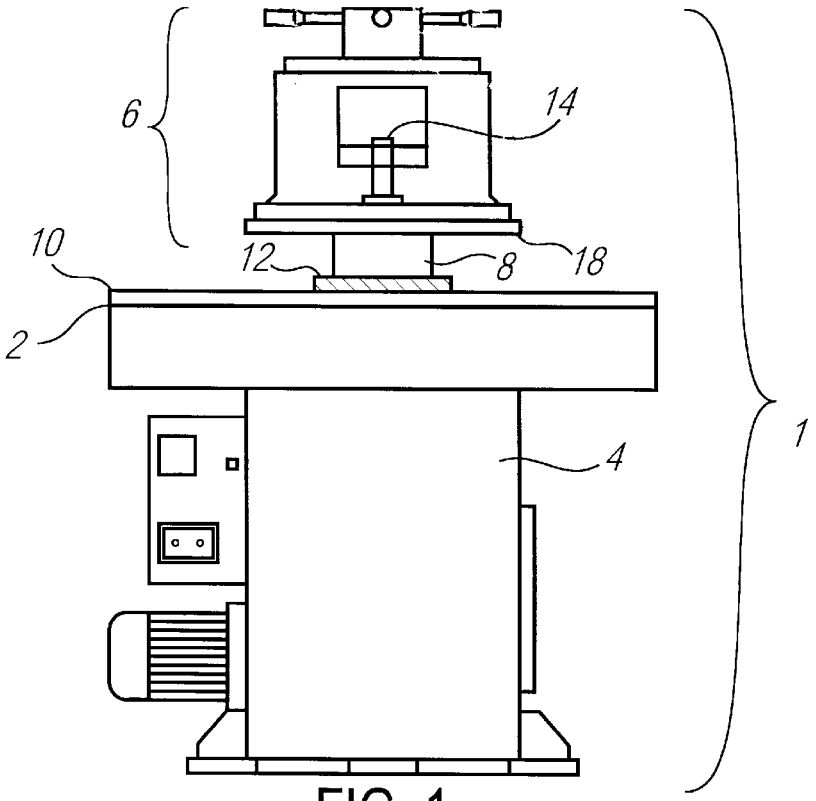
FIG. 1 shows a front elevational view of a press for practicing a method of manufacturing die cut confetti.
Figure 2:
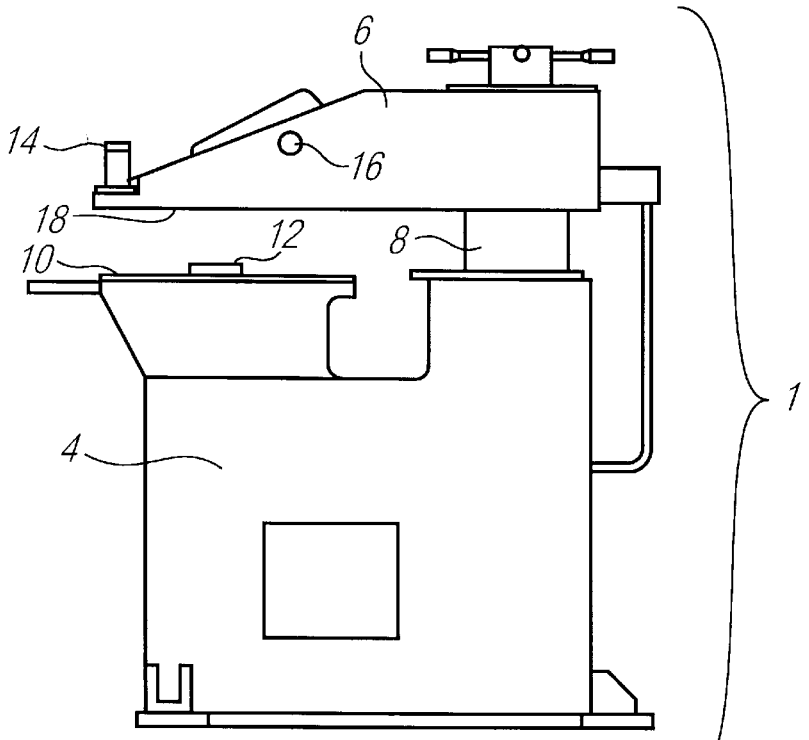
FIG. 2 depicts a side elevational view of a press for practicing a method of manufacturing die cut confetti.

FIG. 1 shows a front elevational view of a swing arm cutting press, model: Spring 19, manufactured by Meccanica ALLEVI Vigevano s.p.a. FIG. 2 shows a corresponding side elevational view of the same machine. This cutting press is an example of the type of cutting press used in the manufacture of die cut confetti in accordance with the present invention. Those skilled in the art will recognize that other die cut machines can be used to practice the inventions described herein.

The cutting press 1 has a flat horizontal working area 2 supported by a base 4 and a moveable head 6 attached to the base 4 by arm 8. Cutting press 1 is a standard hydraulic press that is well known to those skilled in the art and is adjustable so that various amounts of force can be applied to various types and amounts of material.

Tissue paper is milled at ten pound basis weight. Preferably, a dip dyed tissue paper such as Madras weave available from Crystal Tissue Company, which is a relatively porous tissue, is run through flame retardant baths of ammonium phosphate ($NH_4H_2PO_4$) resulting in a twelve pound basis weight end product. Although flame retardant confetti is preferred for safety reasons, confetti can also be made of untreated tissue paper. In either case, confetti can be made from tissue paper of eight pound basis weight to eighty pound basis weight. However, ten to twelve pound basis weight is preferred. Confetti can also be made from any metallized vinyl film, preferably self extinguishing PVC film of eighty gauge. However, metallized film of sixty to one hundred and sixty gauge can be used.

The rolled stock of treated twelve pound basis weight tissue paper is cut into sheet stacks of about twenty inches by thirty inches. A stack 10 of twelve pound flame retardant tissue paper is placed on working area 2. Stack 10 of tissue paper may be of one sixteenth to one inch thick (about 30 to 480 sheets), preferably one quarter inch thick for a five to six cavity gang die, one half inch thick for a single cavity die. Alternatively, stack 10 may be metallized film of fifteen to two hundred sheets thick, preferably one hundred sheets thick for a five to six cavity gang die and two hundred and fifty sheets thick for a single cavity die. In fact, as few as one sheet of tissue paper or metallized film can be cut by the disclosed method; however, for mass production of confetti, single sheet cutting is inefficient.

The hydraulic cutting press 1 depicted in FIGS. 1 and 2 is set to a specific setting to apply a sufficient amount of force to a die or gang die 12 which has been placed on top of a tissue paper stack 10. The spring 19 has the capacity to exert a proximal force of about 21 tons. The appropriate amount of pressure to be applied is proportional to the total linear inches of die cutting edges and the thickness of the material to be cut. For three to five linear inches of cutting blade, one ton of pressure will cut one quarter inches of tissue paper.

Hydraulic cutting press 1 is activated by simultaneously pushing center button 14 and one of the two side buttons 16 which actuates the hydraulic press so that the hydraulic press head 6 is lowered towards the die 12 and tissue stack 10. As the hydraulic press head 6 lowers, plate 18 of head 6 pushes down on die 12 causing die 12 to cut tissue stack 10 into confetti of the desired size and shape. The hydraulic press head 6 then raises up to allow the user to remove die 12 and collect a stack of confetti. The confetti stack can then be removed from the working area for packaging or the process can be repeated without removing the confetti from the die cavity to create a thicker stack of cut confetti. This process can be repeated until all the available space of the stack 10 of tissue paper has been cut. Then, preferably the stacks of cut confetti are burst so that every piece of confetti is separated from every other piece of confetti. This allows each piece of confetti to fall individually when ejected from a propulsion device, such as a cannon or tossed into the air by hand.

Figure 3:
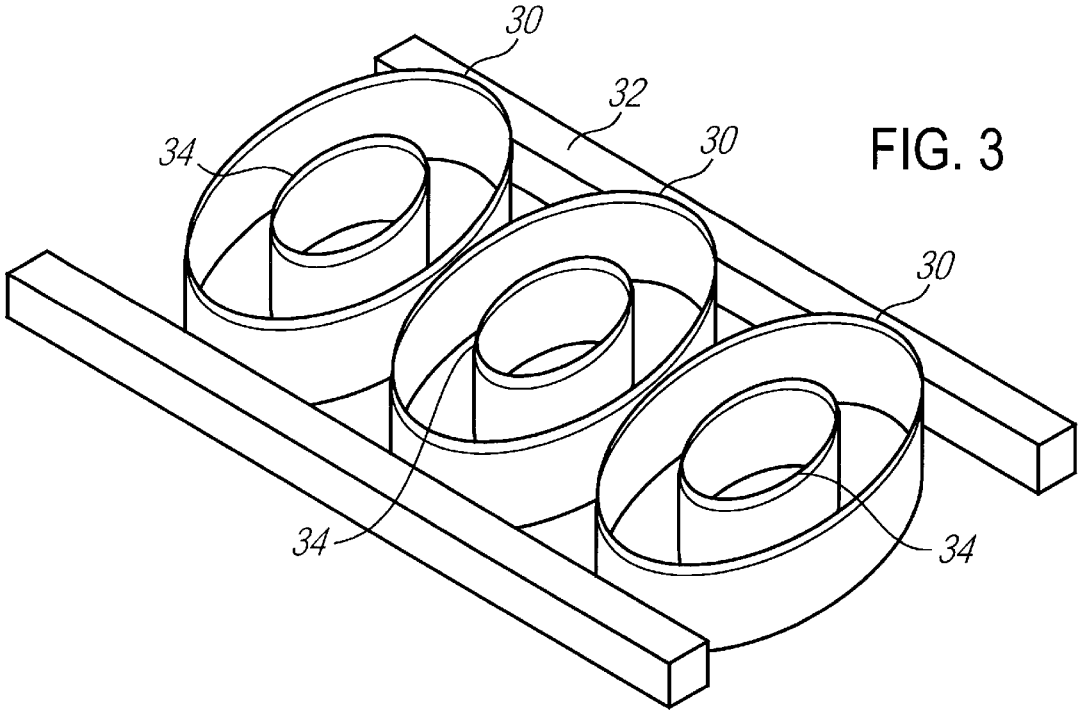
FIG. 3 shows a bottom right perspective view of a gang die for forming doughnut shaped confetti.
Figure 4:
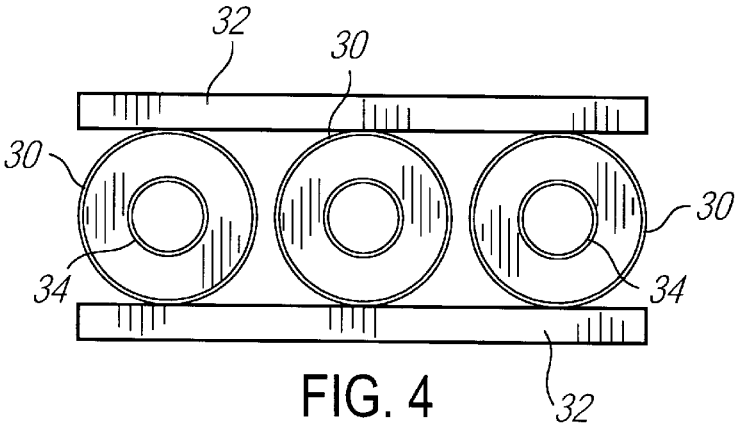
FIG. 4 shows a bottom plan view of a gang die for forming doughnut shaped confetti.
Figure 6:
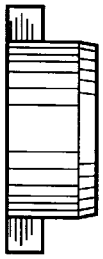
FIG. 6 illustrates a right side elevational view of a gang die for forming doughnut shaped confetti.
Figure 5:
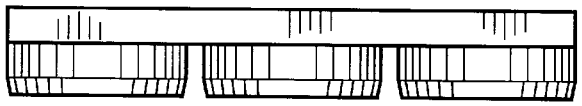
FIG. 5 depicts a front side elevational view of a gang die for forming doughnut shaped confetti.
Figure 7:
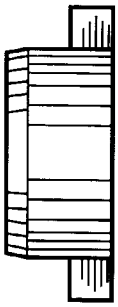
FIG. 7 depicts a left side elevational view of a gang die for forming doughnut shaped confetti.
Figure 8:
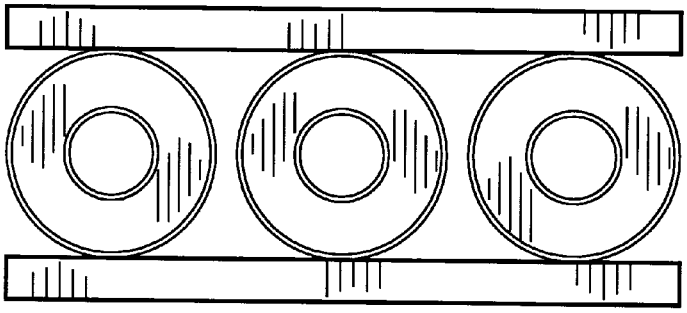
FIG. 8 depicts a top plan view of a gang die for forming doughnut shaped confetti.
Figure 9:
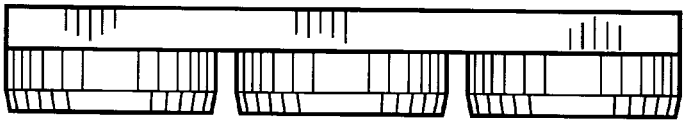
FIG. 9 displays a rear side elevational view of a gang die for forming doughnut shaped confetti.

FIG. 3 shows a bottom right perspective view of the gang die and individual inner dies for forming doughnut shaped confetti; FIG. 4 shows a bottom plan view; FIG. 5 shows a front side elevational view; FIG. 6 shows a right side elevational view; FIG. 7 shows a left side elevational view; FIG. 8 depicts a top plan view; and FIG. 9 shows a rear side elevational view. As shown in FIG. 3, individual dies are welded onto metal pull bars 32 which hold the gang die together. In this embodiment the dies 34 for making the holes in the doughnut shaped confetti are not attached to the gang die. The holes may therefore be made concentric with the outer edge of the confetti or to one side of the confetti, depending upon where the hole-making die is placed within the cavity.

The open ended construction of the gang die is preferred over the closed end construction as it allows the confetti to be easily removed from the individual dies without damaging the stacks of confetti.

Preferably the dies used are forged clearance dies with a high polished finish and an extended cutting edge. The forged clearance dies have a blade height of one and one quarter inches and cutting edge height of approximately one eighth of an inch. As those skilled in the art of die cutting will readily recognize, the cavity of the forged clearance die widens along the height of the blade.

Alternatively, flexible steel dies with a waxed finish can be used. The flexible steel die has a cavity of about one and one quarter inches in height and a cutting edge height of about one sixteenth inch. Additionally, for either type of die breakaway chisel arms may be used to release pressure and allow thicker stacks of paper to be cut. It is also preferred to have pressure relief notches cut out of the top edge of the die to allow air to escape as the confetti fills the die cavity.

It is important to keep gang dies sharp to maximize their cutting effectiveness. If too much force is applied to the dies, the edges of the stacks of tissue confetti may fuse. However, unlike the prior art close ended gang die, fusing with an open die is limited to the edges of the confetti, which is much easier to burst as opposed to tearing each individual piece of confetti off a fused stack. In the case of metallized vinyl confetti, the confetti will crinkle or warp when too much force is applied. To maximize the quality of the shapes of die cut confetti and minimize the tissue scraps that the individual dies on the gang die should be approximately one quarter inch apart. Although individual dies can be used to create the confetti disclosed herein, for mass production gang dies are preferred.

Figure 10:
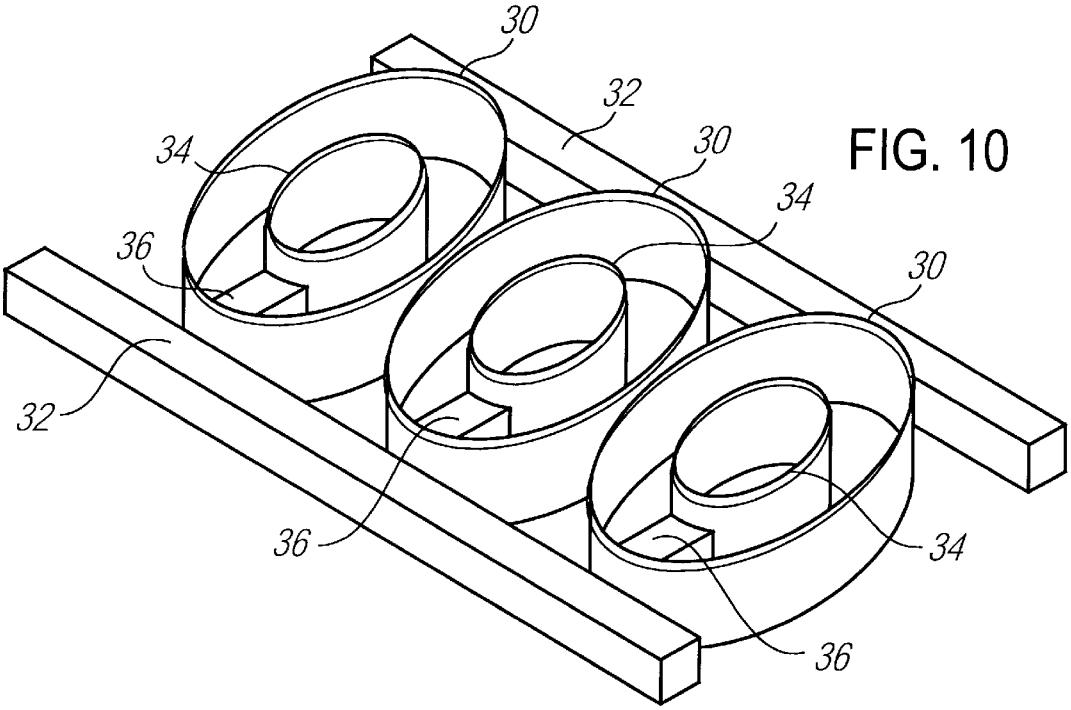
FIG. 10 shows a bottom right perspective view of a gang die for forming doughnut shaped confetti.
Figure 11:
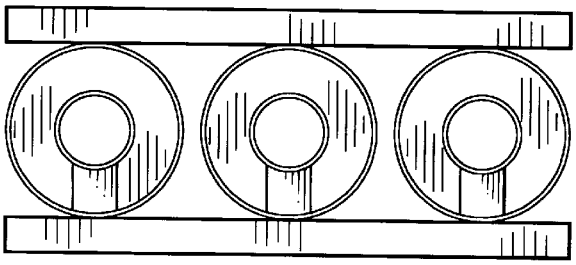
FIG. 11 shows a bottom plan view of a gang die for forming doughnut shaped confetti.
Figure 13:
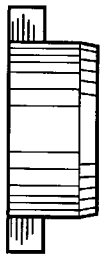
FIG. 13 illustrates a right side elevational view of a gang die for forming doughnut shaped confetti.
Figure 12:
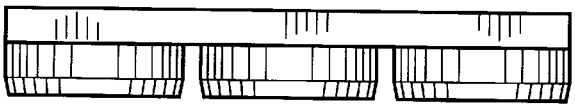
FIG. 12 depicts a front side elevational view of a gang die for forming doughnut shaped confetti.
Figure 14:
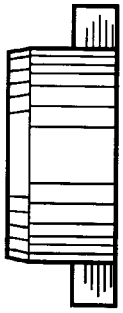
FIG. 14 depicts a left side elevational view of a gang die for forming doughnut shaped confetti.
Figure 15:
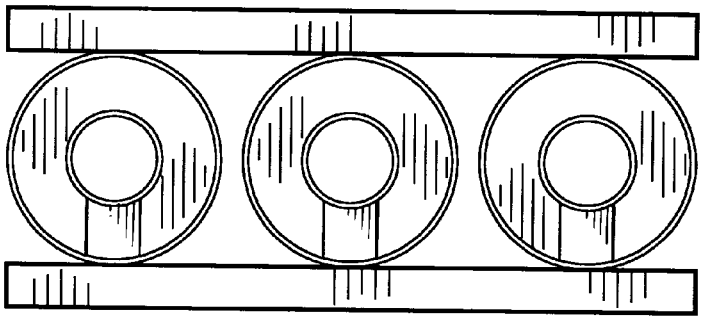
FIG. 15 depicts a top plan view of a gang die for forming doughnut shaped confetti.
Figure 16:
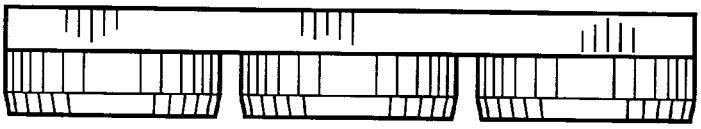
FIG. 16 displays a rear side elevational view of a gang die for forming doughnut shaped confetti.

FIG. 10 shows a bottom right perspective view of the gang die for forming doughnut shaped confetti; FIG. 11 shows a bottom plan view; FIG. 12 shows a front side elevational view; FIG. 13 shows a right side elevational view; FIG. 14 shows a left side elevational view; FIG. 15 depicts a top plan view; and FIG. 16 shows a rear side elevational view. As shown in FIG. 10, individual dies are welded onto metal pull bars 32 which hold the gang die together. Unlike the gang die of FIG. 3 where individual dies have to be placed inside the gang die cavities in order to create the confetti holes, in FIG. 10, the dies 34 for making the holes are welded to the gang die via metal cross bars 36. Metal cross bars may be singular as shown in FIGS. 11 and 12 or may be doubled for each inner die to provide additional strength to the gang die. Metal cross bars 36 have a reduced thickness and are attached at the top of the gang die (the side opposite the blade) to allow maximal confetti cutting within each die. With this construction, doughnut shaped confetti of a consistent shape can be made. In addition, the inefficiency of having to place each individual "hole making" die inside each cavity of the gang die is eliminated.

Further efficiency in the manufacture of confetti is allowed by utilizing the "holes" as confetti. Consequently, in the doughnut shaped confetti example, both the center and the ring may be used as confetti. Alternatively, any of the various die cut shapes disclosed in U.S. U.S. patent application Ser. No. 08/658,834, can also be used as the "interior" which is cut out. Consequently, one can simultaneously produce any of the various shapes disclosed, e.g. doves, hearts, bells, leaves, stars and an outline of those shapes which will have a hover like fall pattern. These other "cutout" confetti designs may utilize either a gang die design as exemplified in either FIGS. 3–9 or 10–16. And, as with the holes of the doughnut shaped confetti, the interior "cutout" can be used as confetti as well.

Figure 17:
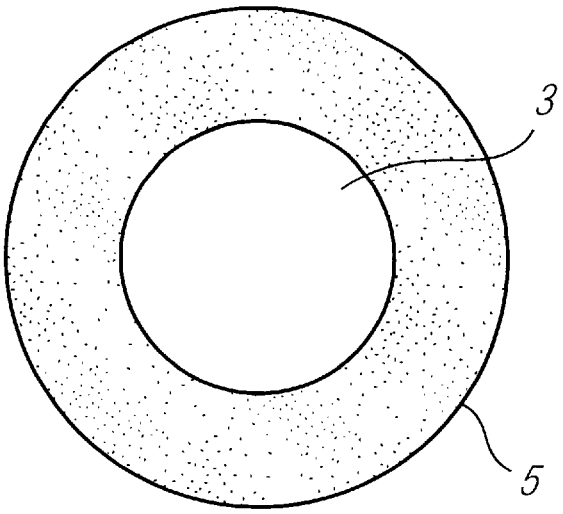
FIG. 17 depicts a top plan view of a large sized piece of doughnut shaped confetti with a wide ring radius.
Figure 18:
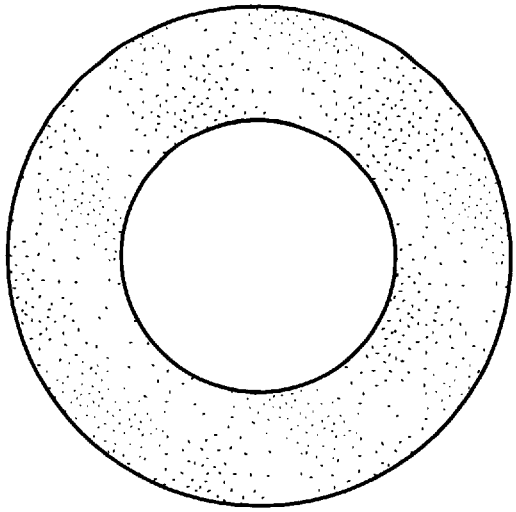
FIG. 18 depicts a bottom plan view of a large sized piece of doughnut shaped confetti with a wide ring radius.

FIG. 17 illustrates a top plan view of a large sized piece of doughnut shaped confetti with a wide ring radius which may be formed by a die with a corresponding doughnut shape. FIG. 18 shows a bottom plan view of the same doughnut shaped confetti. Those skilled in the art will recognize that, the individual pieces of confetti have no appreciable thickness that merits illustration.

As shown in FIG. 17, the doughnut shaped confetti is a circular shaped confetti with a circular concentric hole 3 and a ring 5. The doughnut shaped confetti has a ring thickness of about seven eighths inches (2.2 cm) and a hole radius that is just under one inch (2.4 cm). Hence, the ring thickness to hole radius ratio is a seven to four ratio.

When thrown into the air, this doughnut shaped confetti will slowly descend to the ground in a hover-like manner primarily remaining parallel to the ground. As the confetti descends it oscillates in short back and forth rocking motions in a place parallel to the ground.

Figure 19:
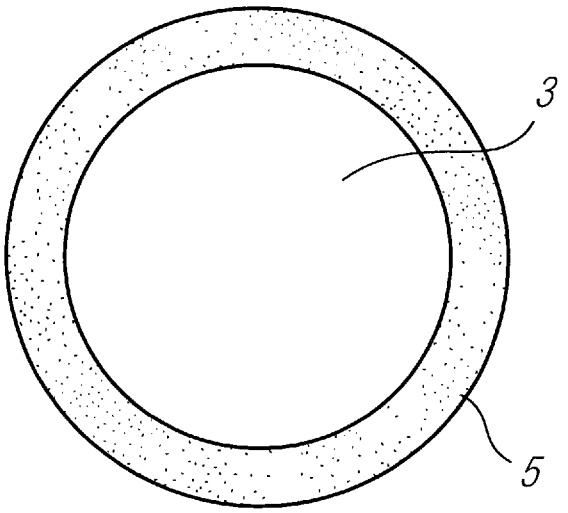
FIG. 19 depicts a top plan view of a large sized piece of doughnut shaped confetti with a narrow ring radius.
Figure 20:
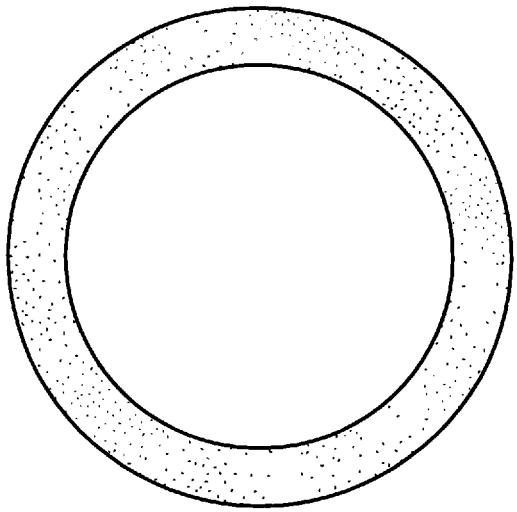
FIG. 20 depicts a bottom plan view of a large sized piece of doughnut shaped confetti with a narrow ring radius.

FIG. 19 illustrates a top plan view of a piece of doughnut shaped confetti with a narrower ring than that illustrated in FIG. 17, which may be formed by a die with a doughnut shape. FIG. 20 shows a bottom plan view of a piece of doughnut shaped confetti. Those skilled in the art will recognize that, the individual pieces of confetti have no appreciable thickness that merit the illustration of a side view.

Like the confetti shown in FIG. 17, the doughnut shaped confetti of FIG. 19 is a circular shaped confetti with a circular concentric hole 3 and a ring 5. This doughnut shaped confetti has a ring thickness of about one quarter inch (0.6 cm) and a hole radius that measures about one and one half inches (3.6 cm). This creates a ring thickness to inner radius ratio of six to one. This confetti may be made using gang die with the same configuration as that shown in FIGS. 3 and 10, but with accordingly modified dimensions.

When thrown into the air, this narrower doughnut shaped confetti will descend in a slow hover-like manner while it slowly oscillates in shallow back and forth motions with an occasional sweeping movement. While descending this confetti primarily remains in a plane parallel to the ground.

Figure 21:
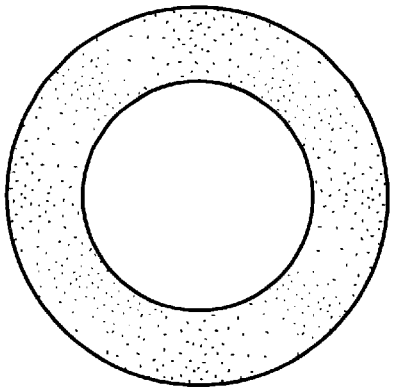
FIG. 21 depicts a top plan view of a medium sized piece of doughnut shaped confetti.
Figure 22:
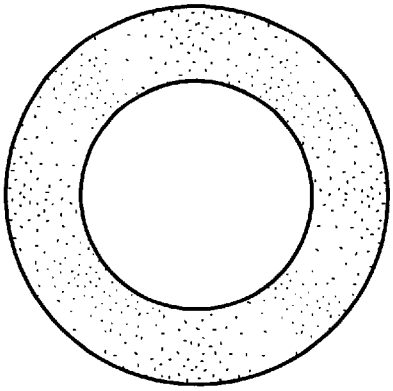
FIG. 22 depicts a bottom plan view of a medium sized piece of doughnut shaped confetti.

The top plan view of the doughnut shaped confetti shown in FIG. 21 and the bottom plan view in FIG. 22 is also circular in shape as the confetti of FIGS. 17 and 19. The doughnut shaped confetti in FIGS. 21 and 22 has a ring thickness to hole radius ratio of about one to two. The approximate measurements the ring thickness and hole radius are three-eighths of an inch (about 1 cm) and just under one inch (2.5 cm) respectively. Those skilled in the art will recognize that, this individual piece of confetti has no appreciable thickness to merit the illustration of a side view. This confetti may be made using a gang die with accordingly modified dimensions.

When thrown into the air this doughnut shaped confetti, shown in FIG. 21, oscillates in irregular shallow rocking motions as it descends to the ground. During the course of descent it primarily remains in a plane parallel to the ground making occasional shallow sweeping dives.

Figure 23:
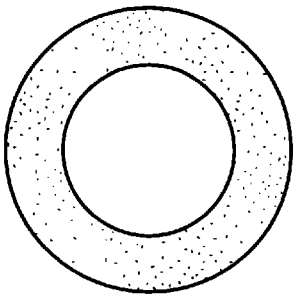
FIG. 23 depicts a top plan view of a small sized piece of doughnut shaped confetti.
Figure 24:
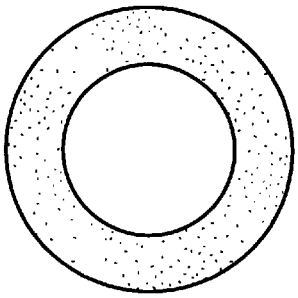
FIG. 24 depicts a bottom plan view of a small sized piece of doughnut shaped confetti.

FIGS. 23 and 24 respectively illustrate a top and bottom plan view of a piece of doughnut shaped confetti that is similar in design to the confetti of FIGS. 17, 19 and 21. However, the doughnut shaped piece of confetti in FIGS. 23 and 24 has a ring thickness to hole radius ratio of two to three. The measurement of the ring thickness is about five sixteenths of an inch (0.08 cm) and the hole radius is about three quarters of an inch (1.5 cm). Those skilled in the art will recognize that, this piece of confetti has no appreciable thickness to warrant illustration of a side view.

When thrown into the air this piece of confetti oscillates back and forth in even rocking motions as it descends to the ground. As the confetti descends there it remains in a plane parallel to the ground and lands in a location that has little or no horizontal displacement from the position from which it was thrown.

Figure 25:
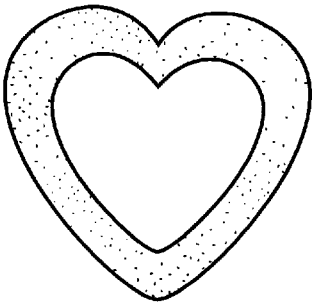
FIG. 25 depicts a top plan view of a piece of outlined heart shaped confetti.
Figure 26:
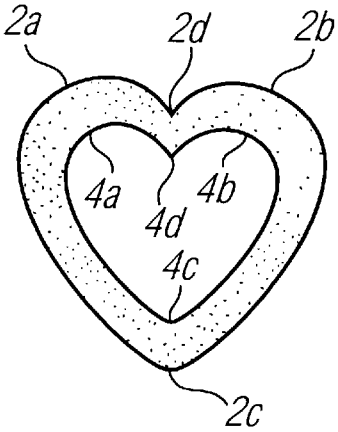
FIG. 26 depicts a bottom plan view of a piece of outlined heart shaped confetti.

FIG. 25 illustrates the top plan view of a piece of heart shaped confetti. FIG. 26 illustrates the bottom plan view of a piece of heart shaped confetti. Those skilled in the art will recognize that, this piece of confetti has no appreciable thickness to merit the illustration of a side view.

As depicted in FIGS. 25 and 26 the piece of heart shaped confetti has a concentric heart shaped hole its center. At the furthest two points, 2*a* and 2*c*, the heart shaped confetti is about two inches in length. The outer distance between the upper two lobes, 2*a* and 2*b*, of the heart is about one and a quarter inches long and the inner distance between the two lobes, 4*a* and 4*b*, is about one inch. The outer distance from the upper concave of the heart to the bottom apex, 2*d* to 2*c*, is about one and three eighths inches and the inner distance from, 4*d* to 4*c*, is about one inch long. The heart shaped confetti of FIGS. 25 and 26 may be formed by a die with the outline of a heart shape.

When this heart shaped confetti is thrown into the air it descends to the ground in short fluttering rocking motions in a plane parallel to the ground. The path of descent is primarily vertical with little or no horizontal displacement from the point from which it was thrown.

Figure 27:
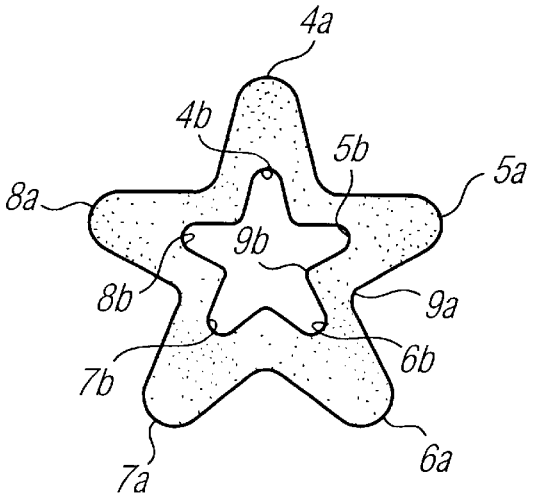
FIG. 27 depicts a top plan view of a piece of outlined star shaped confetti.
Figure 28:
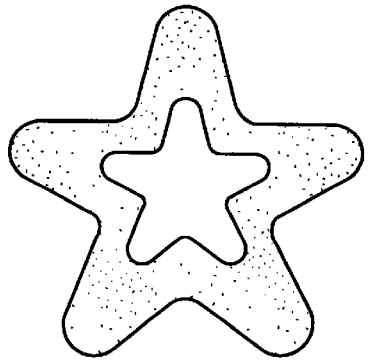
FIG. 28 depicts a bottom plan view of a piece of outlined star shaped confetti.

FIG. 27 illustrates the top plan view of a piece of star shaped confetti. FIG. 28 illustrates the bottom plan view of a piece of star shaped confetti. Those skilled in the art will recognize that, the individual pieces of confetti have no appreciable thickness that merits illustration of a side view.

As illustrated in FIGS. 27 and 28 the piece of star shaped confetti has a concentric star shaped hole in its center. The star shaped confetti as shown in FIG. 27 is in the form of a five pointed star, although many other star shapes are possible. The star shaped confetti has five outer and five inner points 4*a*, 4*b*, 5*a*, 5*b*, 6*a*, 6*b*, 7*a*, 7*b*, 8*a* and 8*b*. The distance between 4*a* and 4*b* is about three-eighths inches (1 cm), the distance between 9*a* and 9*b* is about one quarter inch (0.8 cm). The distance between 4*a* and 6*a* or 7*a* is one and seven eighths inches (4.8 cm) and the distance between 4*b* and 6*b* or 7*b* is one inch (2.5 cm). This piece of confetti may be formed by a die with the outlined shape of a five pointed star.

When thrown into the air, this outlined star shaped confetti descends to the ground in quick irregular rocking movements. Occasionally the empty star shaped confetti sharply dives and later resumes the described rocking motion.

Figure 29:
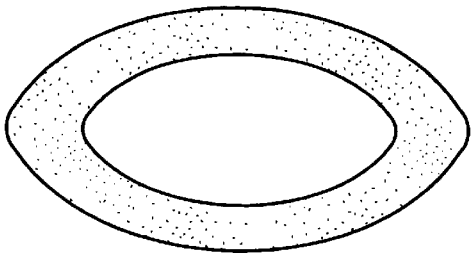
FIG. 29 depicts a top plan view of a piece of outlined football shaped confetti.
Figure 30:
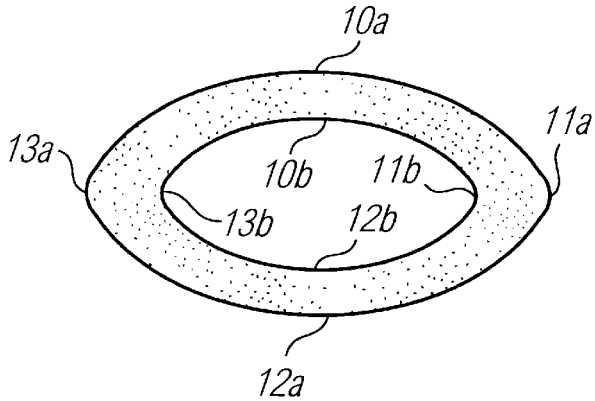
FIG. 30 depicts a bottom plan view of a piece of outlined football shaped confetti.

FIG. 29 illustrates a top plan view of a piece of football shaped confetti. FIG. 30 illustrates a bottom plan view of a piece of football shaped confetti. Those skilled in the art will recognize that, this piece of confetti has no appreciable thickness that merits illustration of a side view.

As shown in FIGS. 29 and 30 the piece of confetti is football shaped with a concentric football shaped hole in the center. The length of the football shaped confetti at the outer most points, 13*a* to 11*a*, is about three and one quarter inches (8.3 cm) and the length at the corresponding inner points, 13*b* to 11*b*, is about two and three eighths inches (6 cm). The width of the confetti at the outer most points, 10*a* to 12*a*, is about one and seven eighths inches (4.7 cm) inches and the width at the corresponding inner points, 10*b* to 12*b*, is one and one eighths inches (2.9 cm). The thickness of the football cutout distance between 13*a*–13*b* or 10*a*–10*b* is about three eighths inches (1 cm). The football shaped confetti of FIGS. 29 and 30 may be formed by an open gang die shaped in the outline of a football.

When thrown into the air, this football shaped confetti slowly descends to the ground in a hover-like manner in a plane parallel to the ground. The confetti moves in a shallow and irregular rocking motion that is occasionally interrupted with a shallow sweeping dive.

Figure 31:
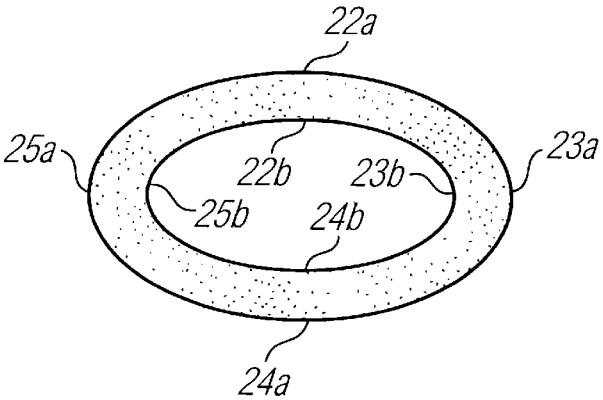
FIG. 31 depicts a top plan view of a piece of outlined oval shaped confetti.

FIG. 31 illustrates a top plan view of a piece of oval shaped confetti. FIG. 31 illustrates a bottom plan view of a piece of oval shaped confetti. Those skilled in the art will recognize that, this piece of confetti had no appreciable thickness that merits illustration of a side view.

Figure 32:
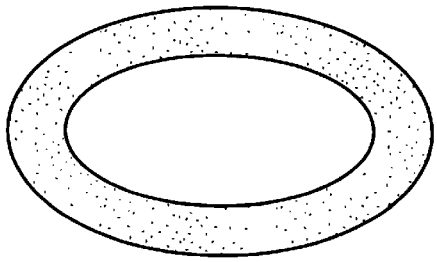
FIG. 32 depicts a bottom plan view of a piece of outlined oval shaped confetti.

As shown in FIGS. 31 and 32 the piece of confetti is oval shaped with an oval shaped concentric hole in the center. The length of the oval shaped confetti at the outer most points, 25*a* to 23*a*, is about two and one quarter inches (5.6 cm) and the length at the corresponding inner points, 25*b* to 23*b*, is about two and five eighths inches (4.2 cm). The width of the confetti at the outer most points, 22*a* to 24*a*, is about one and one quarter inches (3.2 cm) and the width at the corresponding inner points, 22*b* to 24*b*, is about six eighths inches (1.8 cm). This piece of oval shaped confetti was formed by a gang die shaped in the outline of an oval.

When thrown into the air, this oval shaped confetti slowly descends to the ground in a hover-like manner in a plane parallel to the ground. The confetti moves in a shallow and irregular rocking motion that is occasionally interrupted with a shallow sweeping dive.

Figure 33:
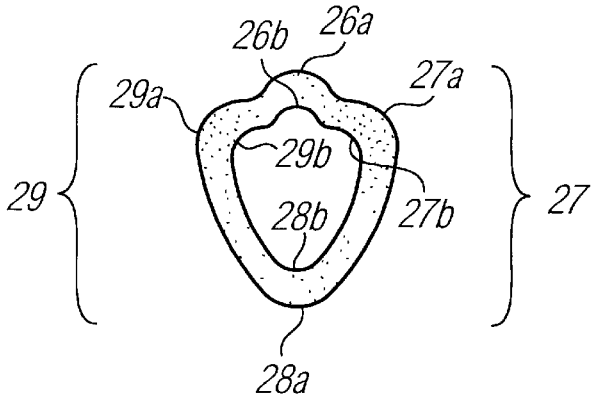
FIG. 33 depicts a top plan view of a piece of outlined acorn shaped confetti.
Figure 34:
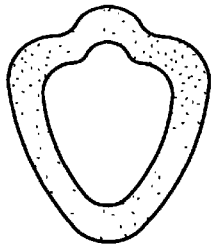
FIG. 34 depicts a bottom plan view of a piece of outlined acorn shaped confetti.

FIG. 33 illustrates the top plan view of a piece of acorn shaped confetti. FIG. 34 illustrates the bottom plan view of a piece of acorn shaped confetti. Those skilled in the art will recognize that, the individual pieces of confetti have no appreciable thickness that merits illustration of a side view.

As shown in FIGS. 33 and 34 the piece of confetti is acorn shaped with a concentric acorn shaped hole in the center. The acorn shaped confetti is about one and one half inches (4.0 cm) in length as measured from the outer tip 26*a* to the outer base 28*a*. The corresponding length as measured from the inner tip 26*b* and the inner base 28*b* is about one inch (2.5 cm). The acorn shaped confetti has two sides, 27 and 29. At its widest point the distance between the outer edges is about one and one eighths of an inch (3.0 cm) and the distance as measured from between the corresponding inner points is about three quarters of an inch (1.8 cm). The thickness of the acorn cutout, the distance between 26*a*–26*b* or 28*a*–28*b*, is about one quarter inch (0.6 cm). Acorn confetti as shown in FIGS. 33 and 34 may be formed by a die in the outlined shape of an acorn.

When thrown into the air, this acorn shaped confetti quickly descends to the ground in a plane parallel to the ground. As the confetti descends it moves in an irregular rocking motion, that is occasionally interrupted by sweeping side movements.

Figure 35:
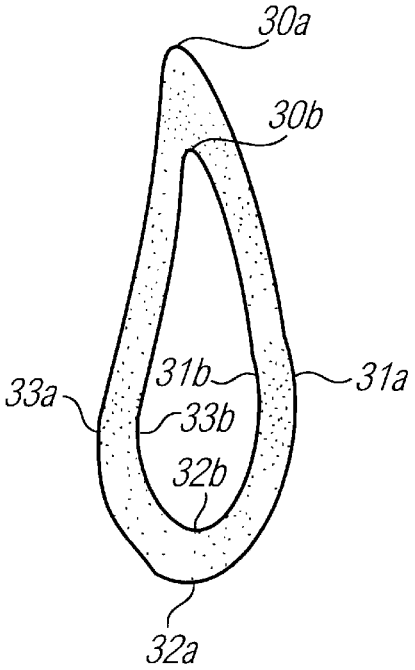
FIG. 35 depicts a top plan view of a piece of outlined willow leaf shaped confetti.
Figure 36:
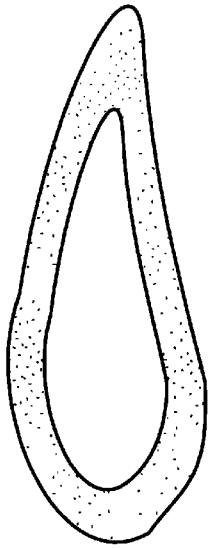
FIG. 36 depicts a bottom plan view of a piece of outlined willow leaf shaped confetti.

FIG. 35 illustrates the top plan view of willow leaf shaped piece of confetti. FIG. 36 illustrates the bottom plan view of a willow leaf shaped piece of confetti. Those skilled in the art will recognize that, the individual piece of confetti has no appreciable thickness that merits illustration of a side view.

As depicted in FIG. 35 the willow leaf shaped confetti is lanceolate in shape with an outer tip 30*a*, an outer base 32*a* and two outer sides 31*a* and 33*a*. The willow leaf shaped confetti has a concentric willow leaf shaped hole in its center. The willow leaf shaped confetti is about four and one half inches in length from tip 30*a* to base 32*a* (11.5 cm). The corresponding length as measured from the inside tip 30*b* to the inside base 32*b* is about three and three-eighths inches (8.5 cm). At the widest point between the outer sides, 31*a* to 33*a*, the leaf measures about one and one half inches (4.0 cm). The corresponding width as measured from the inner points, 31*b* to 33*b*, is about under one inch (2.5 cm). The willow leaf confetti of FIGS. 35 and 36 may be formed by a die in the outlined shape of a willow leaf.

When thrown into the air willow leaf shaped confetti slowly descends in a hovering manner. Typically, as the willow shaped confetti hovers downward it moves in quick side to side movements. Occasionally, the confetti may dart or swoop as it descends to the ground with the confetti leaf tip 32*a* leading the descent of the swooping or darting motion.

Figure 37:
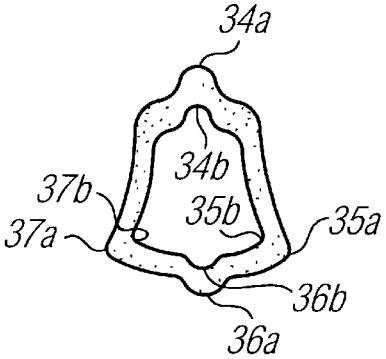
FIG. 37 depicts a top plan view of a piece of outlined bell shaped confetti.
Figure 38:
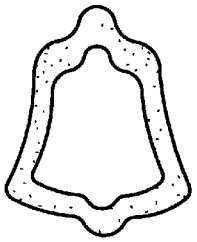
FIG. 38 depicts a bottom plan view of a piece of outlined bell shaped confetti.

FIG. 37 illustrates the top plan view of a bell shaped confetti. FIG. 38 illustrates the bottom plan view of a bell shaped confetti. Those skilled in the art will recognize that, this piece of confetti has no appreciable thickness that merits illustration of a side view.

FIG. 37 shows the bell shaped confetti which has a top 34*ab*, a base 35*ab* and 37*ab*, and a clapper 36*ab*. The distance from the outer top 34*a* to the end of the clapper 36*a* is about two inches (5.0 cm). The corresponding length between the inner points 34*b* to 36*b* measures about one and a half inches (3.5 cm). The distance across the base at it widest point, as measured from the outer edges, is one an five eighths inches (4.0 cm). The corresponding width as measured from the inner edges is about one and one eighths of an inch (2.8 cm). The thickness of the bell shaped cutout, the distance between 36*a*–36*b* or 34*a*–34*b*, is about one quarter inch (0.6 cm). Bell shaped confetti of FIGS. 35 and 37 may be formed by an open die or an open gang die in the outlined shape of a bell.

When the bell shaped confetti is thrown into the air, it floats down in a hovering motion. As the confetti descends it makes shallow sweeping dives with the top edge 34*a* leading the dive.

Based upon the above described flight patterns of the various confetti designs, it has been found that a ring thickness or cutout thickness of about 0.5 to 1 cm or one quarter to one half inch produces an aerodynamic hovering effect of virtually no flipping or fluttering of the confetti regardless of the shape of the confetti. Shapes that are more circular in nature, such as doughnut rings, ovals and hearts) tend to descend in a fairly straight vertical path without oscillating back and forth in a plane parallel to the ground. The greater the ring radius or cutout thickness the greater the oscillation peaks.

While various apparatus and methods of making and using die cut confetti have been described in order to make the invention known to those skilled in the art, it should readily be apparent that many more modifications of the apparatus and methods disclosed are possible without departing from the inventive concepts contained herein. The foregoing description, therefore, should be taken as illustrative and not limiting in any sense.

What is claimed is:

1. A method of manufacturing a stack of confetti comprising:

(a) stacking a plurality of sheets of lightweight sheet material into a first stack at least one sixteenth inches high;

(b) placing onto said first stack an open-ended gang die having a plurality of cavities with a cutting edge measured in linear inches;

(c) placing a plurality of open-ended dies onto said first stack, wherein at least one of said plurality of dies is placed inside each cavity of said gang die, and wherein each of said plurality of dies is smaller than each cavity of said gang die; and (d) applying sufficient force to said gang die and said plurality of dies to cut said first stack into a plurality of second stacks and a plurality of at least third stacks of lightweight material, wherein said plurality of second stacks has the shape of the cavities of said gang die with an at least one hole the shape of the cavity of at least one of said plurality of dies without fusing said sheets of lightweight material to each other, and wherein said plurality of at least third stacks has the shape of said plurality of dies without fusing said sheets of lightweight material to each other.

2. The method of claim 1 further comprising the step of bursting each said second stack and each said at least third stack of lightweight material to separate said sheets of lightweight material from each other after the step of said applying sufficient force to said gang die and said plurality of dies.

3. The method of claim 1 wherein said lightweight material is selected from the group comprising tissue paper and vinyl film.

4. The method of claim 1 wherein said gang die has a plurality of circle shaped cavities.

5. The method of claim 1 wherein at least one of said plurality of dies has a circle shaped cavity.

6. A method of manufacturing a stack of confetti comprising:

(a) stacking a plurality of sheets of lightweight sheet material into a first stack;

(b) placing onto said first stack an open-ended gang die having a plurality of outer cavities and having a plurality of inner cavities, wherein each of said outer cavities includes at least one inner cavity;

(c) applying sufficient force to said gang die to cut said first stack into a plurality of second stacks and a plurality of at least third stacks of lightweight material, wherein said plurality of second stacks has the shape of the outer cavities of said gang die with an at least one hole the shape of the at least one inner cavity for each outer cavity of said gang die without fusing said sheets of lightweight material to each other, and wherein said plurality of at least third stacks has the shape of said plurality of inner cavities without fusing said sheets of lightweight material to each other; and (d) bursting each said second stack and each said at least third stack of lightweight material to separate said sheets of lightweight material from each other.

7. The method of claim 6 wherein said lightweight material is selected from the group comprising of tissue paper and vinyl film.

8. The method of claim 6 further comprising repeatedly cutting said first stack to create a plurality of second stacks and a plurality of at least a third stacks.

9. The method of claim 6 wherein said dies have a cutting surface measured in linear inches and wherein said force is applied in the proportion of one ton per three linear inches.

10. The method of claim 6 wherein said stack of tissue paper is at least one sixteenth inches high.

11. The method of claim 6 wherein the shape of the outer cavity of said die is a circle.

* * * * *

UNITED STATES PATENT AND TRADEMARK OFFICE

CERTIFICATE OF CORRECTION

PATENT NO. : 5,911,805
DATED : June 15, 1999
INVENTOR(S) : STERR et al.

It is certified that error appears in the above-identified patent and that said Letters Patent is hereby corrected as shown below:

In claim 8 (Col. 10, l. 55), delete "stacks" and insert therefor -- stack --.

In claim 10 (Col. 10, l. 60), delete "inches" and insert therefor -- inch --.

Signed and Sealed this

Fourteenth Day of December, 1999

*Attest:*

*Attesting Officer*

Q. TODD DICKINSON

*Acting Commissioner of Patents and Trademarks*